US009649647B2

(12) United States Patent
Krogedal

(10) Patent No.: US 9,649,647 B2
(45) Date of Patent: May 16, 2017

(54) PAINT COLOR CHANGER

(71) Applicant: ABB Technology AG, Zurich (CH)

(72) Inventor: Arnulf Krogedal, Sandnes (NO)

(73) Assignee: ABB SCHWEIZ AG, Baden (CH)

( * ) Notice: Subject to any disclaimer, the term of this patent is extended or adjusted under 35 U.S.C. 154(b) by 4 days.

(21) Appl. No.: 14/799,635

(22) Filed: Jul. 15, 2015

(65) Prior Publication Data

US 2016/0052004 A1 Feb. 25, 2016

(30) Foreign Application Priority Data

Aug. 19, 2014 (EP) ..... 14002886

(51) Int. Cl.

| | |
|---|---|
| ***B05B 7/26*** | (2006.01) |
| ***B05B 15/02*** | (2006.01) |
| ***B05B 12/14*** | (2006.01) |
| ***F17D 3/03*** | (2006.01) |

(52) U.S. Cl.

CPC ..... *B05B 7/26* (2013.01); *B05B 12/149* (2013.01); *F17D 3/03* (2013.01); *B05B 15/025* (2013.01)

(58) Field of Classification Search

CPC ..... B05B 7/26; B05B 12/149; B05B 12/14; B05B 12/1409; B05B 12/1418; B05B 15/025; F17D 3/03

USPC ..... 137/237, 238, 240, 625.19, 625.41, 595

See application file for complete search history.

(56) References Cited

U.S. PATENT DOCUMENTS

| | | | | |
|---|---|---|---|---|
| 4,487,367 | A * | 12/1984 | Perry et al. | B05B 12/14 239/112 |
| 4,489,758 | A * | 12/1984 | Malarz et al. | B05B 1/3006 137/881 |
| 5,326,031 | A * | 7/1994 | Konieczynski | B05B 5/1625 239/3 |
| 5,425,968 | A * | 6/1995 | Larson | B01F 15/0237 137/99 |
| 6,284,047 | B1 * | 9/2001 | Yoshida | B05B 3/1064 118/302 |
| 7,097,121 | B2 * | 8/2006 | Giulano | B05B 12/149 137/565.01 |

* cited by examiner

*Primary Examiner* — Kevin Lee
(74) *Attorney, Agent, or Firm* — Leydig, Voit & Mayer, Ltd.

(57) ABSTRACT

A color changer is provided that includes a base module having at least two input channels and at least one output channel for paint material connectable to each of the at least two input channels. The color changer further includes at least two paint valves, each of the at least two paint valves corresponding to one of the at least two input channels and configured to close the corresponding input channel and to be opened by the application of air pressure, and at least two pilot air channels, each of the at least two pilot air channels corresponding to one of the at least two paint valves and configured to convey air pressure to the corresponding paint valve to open the corresponding paint valve. Each pilot air channel includes a blow hole and a closing device for closing the blow hole.

9 Claims, 3 Drawing Sheets

PAINT COLOR CHANGER

CROSS-REFERENCE TO RELATED APPLICATIONS

Priority is claimed to European Patent Application no. EP 14 002 886.1, filed on Aug. 19, 2014, the entire disclosure of which is incorporated by reference herein.

FIELD

The invention relates to the field of industrial paint application robots, and specifically to color changers for providing paint materials with different paint colors at the industrial paint application robots.

BACKGROUND

Industrial paint application robots are used for painting objects such as, e.g., car bodies. In order to have an automated paint shop with a high degree of flexibility, such industrial paint application robots need to be prepared to apply paint material with a larger number of different paint colors, for example 20 or 30 colors. Typically, color changers are provided at the robot in order to provide paint material with different paint colors directly at the robot. A color changer typically comprises a larger number of input channels for supplying the respective paint material and which lead to a common output channel. Each input channel is provided with a paint valve, so that each of the input channels can be selectively connected with the output channel, which typically leads to a painting device located at a tip of the robot. As the paint color required to be applied during a production process is normally subject to relatively frequent changes during the production process, color changers need to be capable of performing relatively frequent color changes during the production process. It is desirable to reduce the waste of paint material during such color changes.

It is of immense importance for the quality of the painted objects that the applied paint material is not contaminated with a paint material of a color different than the color desired for the painted object. Therefore, a cleaning process is typically required, at the output channel and at the painting device, after each color change. Such cleaning process typically involves applying a cleaning solvent from a dedicated supply line through an output channel leading to the painting device. Furthermore, it is typically necessary to ensure that only one paint valve of the input channels is opened at a particular point in time so as to prevent a mixing of paint materials with different colors in the output channel. An object which has been painted with contaminated paint material typically constitutes waste, and in the worst case, cannot be reused.

Typically, an interlock of the paint valves is based on control logic of, for example, the robot controller, and which controls not only movement of the robot but also the switching operations of the paint valves. A mechanical interlocking mechanism is typically not provided for the paint valves. Paint valves normally comprise, e.g., a spring mechanism, which acts to close the paint valve in a steady state without the need of any further action.

SUMMARY

A color changer is provided herein. The color changer includes a base module having at least two input channels, at least one output channel for paint material connectable to each of the at least two input channels, at least two paint valves, each of the at least two paint valves corresponding to one of the at least two input channels and configured to close the corresponding input channel and to be opened by the application of air pressure, and at least two pilot air channels, each of the at least two pilot air channels corresponding to one of the at least two paint valves and configured to convey air pressure to the corresponding paint valve to open the corresponding paint valve, wherein each of the at least two pilot air channels comprises a blow hole, and a closing device for closing at least one of the blow holes.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
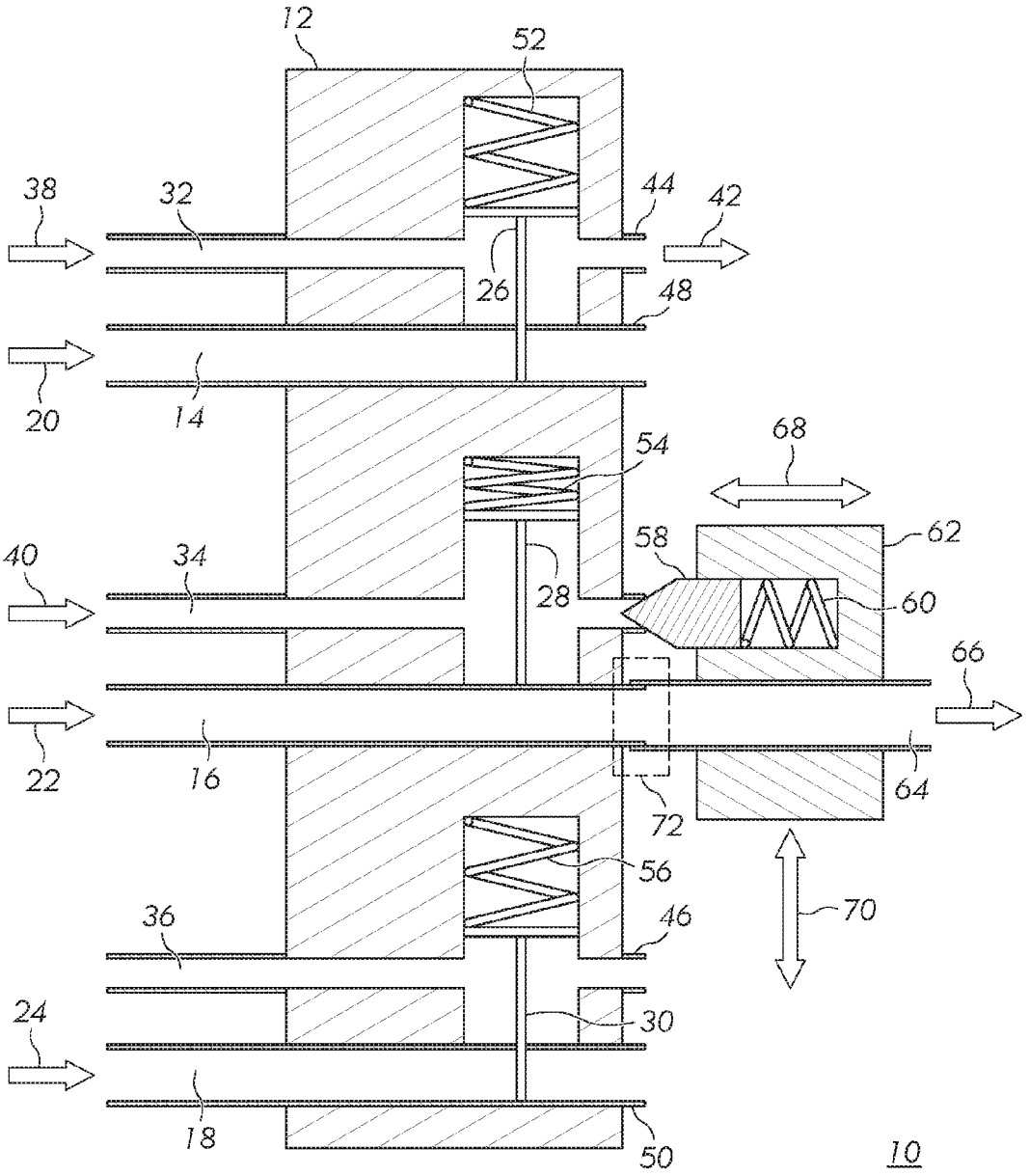
FIG. 1 depicts a first color changer according to an embodiment of the invention.

In prior art color changers where an interlock of the paint valves is based on control logic, a malfunction of the control logic could cause two or more paint valves to be opened at the same time. An embodiment of the invention provides a color changer that is fail safe so that even in case of a the malfunction of the control logic, no more than one paint valve can be opened at the same time.

An embodiment of the invention comprises a base module with at least two input channels leading to an output channel for paint material, each of the at least two input channels being provided with an associated paint valve for closing the input channel in the steady state. Furthermore, each of the associated paint valves can be opened by applying an air pressure through a respective associated pilot air channel. Each of the associated pilot air channels comprises a blow hole and an apparatus for closing the blow hole. In that manner, applying air pressure causes opening of a respective paint valve only in the case that the respective blow hole is closed.

An embodiment of the invention provides, in addition to a condition of an active switching signal, a further mechanical condition, both of which must be fulfilled to make switching of a respective paint valve possible. A paint valve is typically piloted by air pressure wherein the air pressure is switched on and off by a switching device, which is controlled by the switching signal. By providing a blow hole in the pilot air channel no pressure can rise in case of an open blow hole so that the paint valve will not switch even when pressurized pilot air is provided in the pilot air channel. Only when the second condition—i.e. the mechanical closing of the blow hole—is also fulfilled can pressure in the pilot air channel rise and the respective paint valve open. In such manner, the safety of a color changer is increased in an advantageous way and an unintended opening of a paint valve avoided.

According to a further embodiment of the invention one common closing device is provided for selectively closing exactly one of the blow holes. In this case a further safety is added since it is physically excluded, that more than one blow hole is closed at the same time. Thus it is impossible also to mix different paints in the output channel since not more than one paint valve can be switched at the same time.

According to another embodiment of the invention the blow holes are arranged along a path, wherein the closing device comprises a plug which is suitable for closing any of the blow holes, wherein the plug is moveable along the path relative to the base module. Preferably all blow holes are at least similar and arranged within the same plane. Thus one plug is suitable to close each of the blow holes. A plug may be made of a rubber like-material which is pressed against the blow hole in the closing state. It is useful to provide a drive for moving the plug along the path, for example an electro motor or an air turbine. By predefining a path for the plug the plug is easily placeable vis-à-vis to the blow hole to be closed. The degree of freedom in movement of the plug is reduced to forward or backward motion along the path, thus the correct positioning of the plug will be easier to reach and more precise.

According to a further embodiment of the invention the plug is spring-loaded in closing direction of a respective blow hole, so that a respective pressure force is applied on the plug in order to increase the impermeability of the closed blow hole.

According to another embodiment, the path along which the blow holes are arranged is circular. Preferably the plug is arranged at the radial outer end of a rotatable selector device. Thus the plug is easily placeable vis-à-vis to the blow hole by a rotation movement of a selector device which is rotatable relative to the base module around the center axis of the circular path. In the case of 24 equidistant blow holes, for example, the distance in between adjacent blow holes amounts to 15° so that the actual position of rotation determines which of the blow holes is or can be closed.

According to a further embodiment of the invention the selector device plug is additionally moveable in an axial direction for opening and closing a blow hole with the plug. Thus, during a rotation movement, the plug is in an axial distance to the blow holes, which are preferably arranged within the same plane. If the plug has reached a position vis-à-vis to the desired blow hole the plug is moved in the axial direction to the blow hole, so that it is closed in the end.

According to another embodiment of the color changer the outlet ends of the input channels for paint material are arranged along a further circular path around the center axis, wherein the rotatable selector device comprises additionally at least a section of the output channel that's inlet end is—dependent on the actual position of rotation—connectable with a respective outlet end of one of the input channels, wherein the plug and the inlet end of the output channel are arranged in that way within the selector device, that each of the blow holes is or can be closed in the same position of rotation in which the output channel is or can be connected with the outlet end of the associated input channel.

By this a further level of security is introduced since the output channel can mechanically be connected with, at maximum, one of the outlets of the input channels. The outlets of the input channels and the assigned blow holes are arranged always in the same alignment which is fitting to the alignment of the inlet of the output channel and the plug. The rotatable selector device enables an easy selection of the input cannel to be connected with the output channel respectively the associated blow hole to be closed with the plug by a simple rotation. Here three conditions have to be fulfilled, that a paint valve is switching and the output channel gets filled with the desired paint material: 1. An active switching signal for the valve; 2. The associated blow hole has to be closed; 3. The output channel has to be connected with the outlet of the desired input channel.

According to a further embodiment of the color changer the rotatable selector device comprises a cleaning device for cleaning the output channel. For example a supply channel for cleaning solvent and air with a respective paint valve can be provided, which leads to the inlet of the output channel. If all other input channels are closed, the output channel and the atomizer can easily be cleaned by applying a solvent and air mix. Also the outlet of an input channel is cleaned therewith in case that the output channel is connected with the respective outlet of an input channel. Thus according to an aspect of the invention the cleaning device comprises a supply channel for solvent and a cleaning valve.

According to another embodiment, a color changer is provided comprising a base module with at least two input channels leading to an output channel for paint material, wherein each of the at least two input channels is provided with an associated paint valve for closing the input channel in the steady state, wherein each of the associated paint valves can be opened by applying an air pressure through a respective associated pilot air channel, wherein in the outlet ends of the input channels for paint material are arranged along a circular path around a center axis, wherein a selector device is provided, which is rotatable relative to the base module around the center axis of the circular path, wherein the rotatable selector device comprises at least a section of the output channel whose inlet end is—depending on the actual position of rotation—connectable with a respective outlet end of one of the input channels.

In this embodiment of the invention, the rotatable selector device comprises a supply channel for pilot air, whose outlet end is connectable with the respective inlet end of the associated pilot air channel in the same position of rotation. In this case the inlet of a pilot air channel corresponds to a blow hole wherein the other end of the pilot air channel is sealed.

In this embodiment of the invention, two conditions must be fulfilled independently from each other to enable the switching of a paint valve. In this embodiment the application of pilot air is not enabled by sealing a blow hole of a respective pilot air channel with a plug in a selector device, moreover the pilot air is supplied directly from the selector device through the blow hole.

In various embodiments, the selector device comprises a selector which enables the use of exactly one of the pilot air channels. In one variant, the use of the pilot air channel is enabled by closing a blow hole so that a pressure can rise. In another variant the use of the pilot air channel is enabled by applying the pilot air to the pilot air channel directly from the selector device through the blow hole. Both variants exclude the successful application of pilot air to more than one pilot air channel, so that more than one paint valve cannot be opened at the same time.

FIG. 1 shows a color changer 10 in a schematic cross-sectional view. A base part 12, for example milled from a steel block, is provided with input channels 14, 16, 18 leading therethrough. The inlet sides of the input channels 14, 16, 18 are connected to a respective paint supply 20, 22, 24 for paint material with different colors. Each input channel is provided with associated paint valves 26, 28, 30, which each are closed in the steady state by respective springs 52, 54, 56, which are pressing the needles of the paint valves 26, 28, 30 into the input channels 14, 16, 18.

Respective pilot air channels 32, 34, 36 are provided to temporarily apply pressured air 38, 40 to the paint valves 26, 28, 30 in case that they shall be opened. Associated blow holes 44, 46 are provided at the ends of the pilot air channels 32, 34, 36 at the same side of the base part 12 where the outlet sides of the input channels 14, 16, 18 are leading to. In case that a respective blow hole is not closed no pressure can rise within the respective pilot air channels 32, 34, 36 so that the associated paint valves 26, 28, 30 can't open even if pressured air is supplied. The arrow 42 indicates an air flow through a not-closed blow hole.

A selector device 62, also milled from a block of steel, is moveable along the respective surface of the base part 12 in a crosswise 70 and in an axial 68 direction. The selector device 62 comprises a spring-loaded 60 plug 58 which is closing the blow hole of the pilot air channel 34 which is vis-à-vis thereto. Thus the applied pressured air 40 leads to an increase of the pressure within a pressure cylinder of the valve 28, so that the needle is lifting up against the pressure force of the spring 54 and the input channel 22 is opened.

The selector device 62 also includes a section of an output channel 64 which is connected with the outlet of the input channel 16, so that paint material can flow from the paint supply 22 through the opened input channel 16 and through the output channel 64, which are hermetically connected in a coupling section 72. The arrow 66 indicates a paint flow through the output channel to a not shown atomizer By a respective motion of the selector part 62 the output channel 64 can be connected alternatively to either the input channel 14 or the input channel 18, wherein the plug is automatically moved together with the selector device 62 in a closing position for the respective associated blow hole 44, 46.

Figure 2:
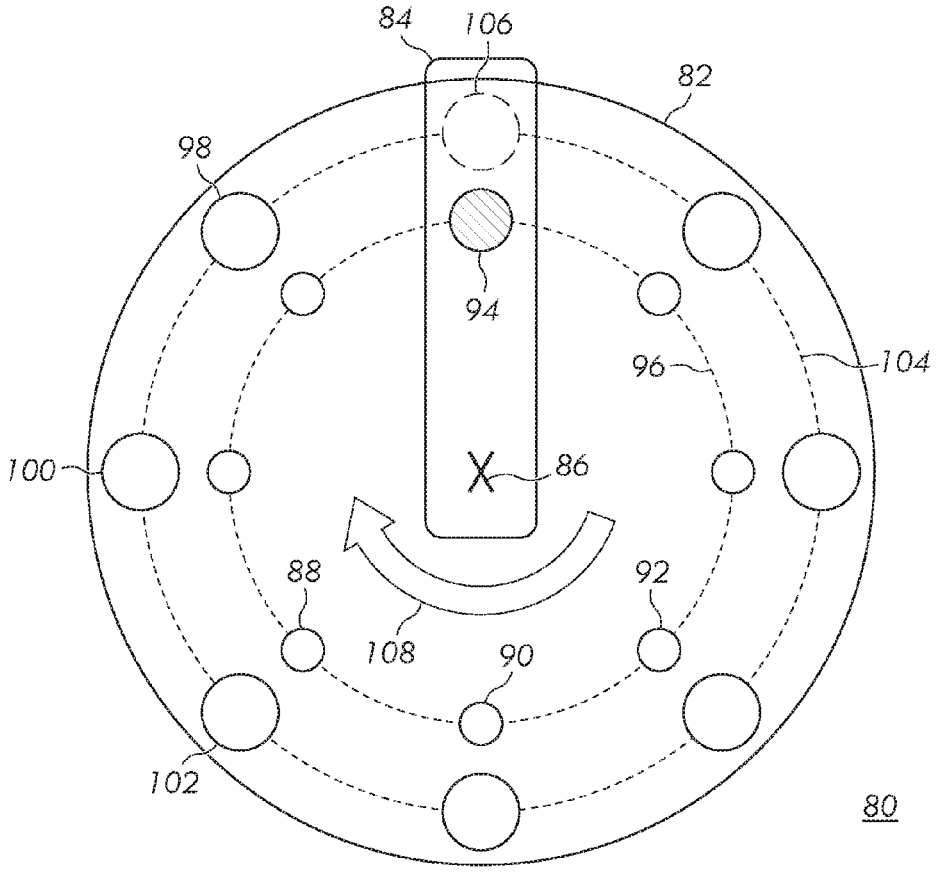
FIG. 2 depicts an exemplary second color changer according to an embodiment of the invention.

FIG. 2 shows a color changer 80 in a schematic top view. A disk-like base 82 module is connected with a selector device 84, which is rotatable 108 around a center axis 86. Several blow holes 88, 90, 92 of respective pilot air channels are arranged on the planar top side of the base module 82 along a circular path 96. In the same angular distance each to each other than the blow holes 88, 90, 92 several outlet ends 98, 100, 102 of associated input channels for paint material are provided along a circular path 104.

The selector device 84 comprises a plug 94 and an output channel 106 which are arranged in the same radial distance to the center axis than the circular paths 96, 104. Thus it is possible to select the respective input channel to be connected with the output channel 106 by a respective rotation 108 of the selector device 84. The angular position of the selector device 84 which is suitable for connecting the selected input channel with the output channel 106 is the same angular position that is required for closing the associated blow hole 88, 90, 92 with the plug 94.

Figure 3:
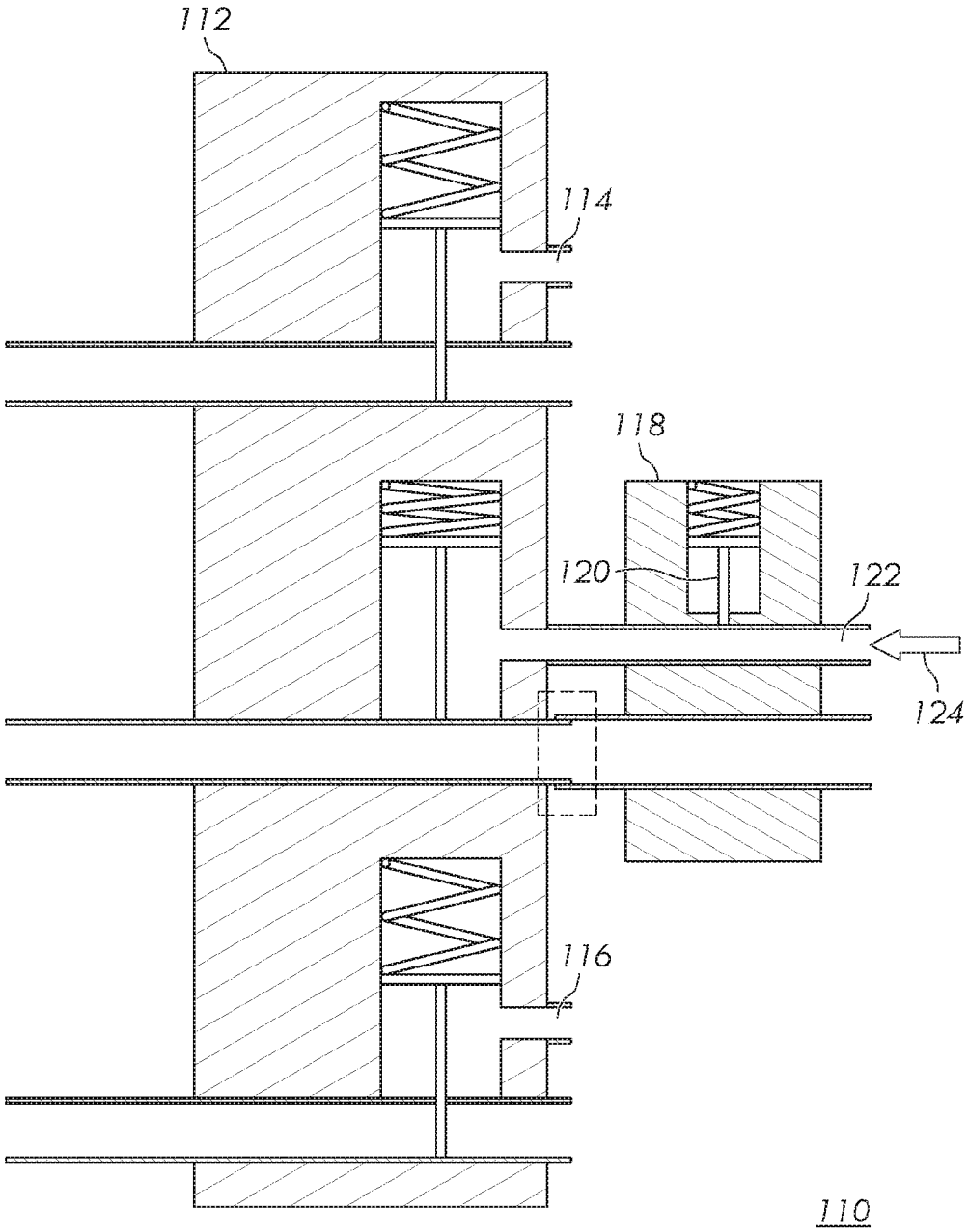
FIG. 3 depicts an exemplary third color changer according to an embodiment of the invention.

FIG. 3 shows a color changer 110 in a schematic cross-sectional view. A base part 112 is provided with input channels leading therethrough. The inlet sides of the input channels are connected to a respective paint supply for paint material with different colors. Each input channel is provided with associated paint valves, which each are closed in the steady state by respective springs, which press the needles of the paint valves into the input channels.

Respective pilot air channels 114, 116 are provided to temporarily apply pressured air to the paint valves in case that they shall be opened. Associated blow holes are provided at the ends of the pilot air channels 114, 116 at the same side of the base part 112 where the outlet sides of the input channels are leading to.

A selector device 118 is moveable along the respective surface of the base part 112 in crosswise and in axial direction. The selector device 118 comprises a pilot air supply channel 122 which is supplied by a pilot air supply 124. A valve 120 is provided to switch the pilot air on and off. In this example, the output channel as the pilot air supply channel are connected to one pair of paint supply channel and associated pilot air channel 114, 116. Thus the applied pressurized pilot air leads to an increase of the pressure within a pressure cylinder of the valve, so that the needle is lifting up against the pressure force of the spring and the respective input channel is opened.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

10 exemplary first color changer
12 base module of first color changer
14 first input channel of base module
16 second input channel of base module
18 third input channel of base module
20 paint supply for first input channel
22 paint supply for second input channel
24 paint supply for third input channel
26 paint valve of first input channel
28 paint valve of second input channel
30 paint valve of third input channel
32 pilot air channel of first paint valve
34 pilot air channel of second paint valve
36 pilot air channel of third paint valve
38 first air pressure
40 second air pressure
42 air flow through blow hole
44 blow hole of first pilot air channel
46 blow hole of third pilot air channel
48 outlet end of first input channel
50 outlet end of third input channel
52 spring of first paint valve

54 spring of first second valve
56 spring of first third valve
58 plug of closing means
60 spring of closing means
62 selector device
64 output channel
66 paint flow through output channel
68 axial movement direction of selector device
72 coupling section
70 crosswise movement direction of selector device
80 exemplary second color changer
82 base module of second color changer
84 selector device of second color changer
86 center axis
88 first blow hole of second color changer
90 second blow hole of second color changer
92 third blow hole of second color changer
94 plug
96 circular path of blow holes
98 outlet end of first input channel
100 outlet end of second input channel
102 outlet end of third input channel
104 circular paths of one ends of input channels
106 output channel
108 rotation direction
110 exemplary third color changer
112 base module of third color changer
114 pilot air channel of first paint valve
116 pilot air channel of third paint valve
118 selector device
120 valve for pilot air
122 pilot air supply channel
124 pilot air supply

What is claimed is:

1. A color changer, comprising a base module having at least two input channels;

at least one output channel for paint material connectable to each of the at least two input channels;

at least two paint valves, each of the at least two paint valves corresponding to one of the at least two input channels and configured to close the corresponding input channel and to be opened by the application of air pressure; and at least two pilot air channels, each of the at least two pilot air channels corresponding to one of the at least two paint valves and configured to convey air pressure to the corresponding paint valve to open the corresponding paint valve, wherein each of the at least two pilot air channels comprises a blow hole, each blow hole being arranged along a path; and a closing device configured to close each of the blow holes, the closing device comprising a plug, the plug being configured to close any of the blow holes and being movable along the path relative to the base module.

2. The color changer according to claim 1, wherein the plug is spring-loaded in a closing direction of a respective blow hole.

3. The color changer according to claim 1, wherein the path is circular.

4. The color changer according to claim 3, wherein the plug is arranged at a radial outer end of a selector device, the selector device being rotatable relative to the base module around a center axis of the circular path, wherein a position of rotation determines which of the blow holes is or can be closed.

5. The color changer according to claim 4, wherein the selector device is additionally moveable in axial direction for opening and closing a blow hole with the plug.

6. The color changer according to claim 4, wherein an outlet end of each of the at least two input channels are arranged along a further circular path around the center axis, wherein the rotatable selector device comprises at least a section of each output channel, each output channel having an inlet end that is connectable with a respective outlet end of one of the at least two input channels, wherein the plug and the inlet end of each output channel are arranged within the selector device such that each of the blow holes is or can be closed in the same position of rotation in which each output channel is or can be connected with the outlet end of one of the at least two input channels.

7. The color changer according to claim 6, wherein the rotatable selector device comprises a cleaner configured to clean each output channel.

8. The color changer according to claim 7, wherein the cleaner comprises:

a supply channel for solvent; and a cleaning valve.

9. A color changer, comprising:

a base module having at least two input channels each having an outlet end, wherein the outlet ends of the at least two input channels are arranged along a circular path around a center axis;

at least one output channel for paint material connectable to each of the at least two input channels;

at least two paint valves, each of the at least two paint valves corresponding to one of the at least two input channels and configured to close the corresponding input channel and to be opened by the application of air pressure;

at least two pilot air channels, each of the at least two pilot air channels corresponding to one of the at least two paint valves and configured to convey air pressure to the corresponding paint valve to open the corresponding paint valve; and a selector device, the selector device being rotatable relative to the base module around the center axis of the circular path, wherein the rotatable selector device comprises at least a section of the at least one output channel that has an inlet end which is connectable with a corresponding outlet end of one of the at least two input channels, and wherein the rotatable selector device further comprises a supply channel for pilot air, the supply channel for pilot air having an outlet end which is connectable with an inlet end of one of the at least two pilot air channels that is in the same position of rotation.

* * * * *